US005228632A

United States Patent [19]

Addison et al.

[11] Patent Number: 5,228,632

[45] Date of Patent: Jul. 20, 1993

[54] DISPENSER FOR ROLLED MATERIAL

[76] Inventors: F. Clark Addison, 3804 W. Eisenhower Ave., Loveland, Colo. 80537; Peder J. Thorstensen, P.O. Box 1025, Loveland, Colo. 80539

[21] Appl. No.: 522,318

[22] Filed: May 11, 1990

[51] Int. Cl.[5] ..... B65H 19/00

[52] U.S. Cl. ..... 242/55.53; 242/55.3; 206/409

[58] Field of Search ..... 242/55.2, 55.3, 55.53, 242/55.54, 55.42; 206/407, 408, 409

[56] References Cited

U.S. PATENT DOCUMENTS

| | | | |
|---|---|---|---|
| D. 188,894 | 9/1960 | Sloier | 242/55.3 |
| 342,354 | 5/1886 | Harper | 242/55.53 |
| 1,013,715 | 1/1912 | Yuste et al. | 206/407 |
| 1,311,758 | 7/1919 | Cowan | 242/55.3 |
| 1,588,577 | 6/1926 | Heifler | 242/55.53 |
| 3,288,329 | 11/1966 | Ketchem | 206/409 |
| 3,523,653 | 8/1970 | Hansen | 242/55.54 |
| 3,539,124 | 11/1970 | Belokin | 242/55.54 |
| 3,612,424 | 10/1971 | Friedel | 242/55.53 |
| 3,664,594 | 5/1972 | Novak | 242/55.53 |
| 3,791,601 | 2/1974 | Broden | 242/55.53 |
| 3,826,361 | 7/1974 | Heckrodt | 206/409 |
| 3,843,071 | 10/1974 | Graham | 242/55.53 |
| 3,930,697 | 1/1976 | Barouh et al. | 206/409 |
| 3,949,947 | 4/1976 | Youngquist et al. | 242/55.53 |
| 4,467,974 | 8/1984 | Crim | 242/55.53 |
| 4,615,442 | 10/1986 | Beeken | 242/55.53 |
| 4,659,028 | 4/1987 | Wren | 242/55.53 |
| 4,690,345 | 9/1987 | Cotey | 242/55.53 |
| 4,836,462 | 6/1989 | Bruss | 242/55.53 |
| 4,936,452 | 6/1990 | Pauley . | |

FOREIGN PATENT DOCUMENTS

| | | | |
|---|---|---|---|
| 1954486 | 6/1970 | Fed. Rep. of Germany | 242/55.53 |
| 251840 | 5/1926 | United Kingdom | 242/55.53 |

*Primary Examiner*—Daniel P. Stodola
*Assistant Examiner*—John Q. Nguyen
*Attorney, Agent, or Firm*—Fields, Lewis, Pittenger & Rost

[57] ABSTRACT

A dispenser for rolled material, such as rolled towel and tissue, includes a receptacle made as two separable interfitting elements so that the rolled material can be easily replaced. One form has a cup-like member with a lid and a separable interfitting horizontal or vertical dispensing slot is provided in the receptacle through which the material is dispensed. Another form has an inner body member that nests in an outer body member with opposed walls defining a dispensing passage and slot. Two different types of rolled material are dispensed from a single dispenser.

10 Claims, 4 Drawing Sheets

DISPENSER FOR ROLLED MATERIAL

TECHNICAL FIELD

This invention relates to a novel and improved dispenser for storing, protecting and dispensing rolled material and is particularly suited for dispensing rolled towel and rolled tissue.

BACKGROUND ART

Rolled material, such as toilet or tissue paper, when carried from place to place frequently unrolls prematurely or becomes damaged by water and/or by being crushed. Accordingly, there is a need for a portable dispenser for rolled toilet and/or tissue paper and like rolled material that protects the material from water or physical damage and premature unwinding and allows the leading end portion to be readily advanced and grasped for pulling from the dispenser. Another desirable feature is to be able to easily replace the rolled material.

Beeken U.S. Pat. No. 4,615,442 discloses a cylindrical container open at one end and having a removable cap with the roll support extending along the axis of the container. The roll support slides axially to expose a roll of material for unwinding.

Belokin U.S. Pat. No. 3,539,124 discloses a container for a paper roll wherein the container is open at the top and opposed roll support hubs are provided in a cover and a bottom wall of the container for supporting the roll of material about a vertical axis. The roll of material is stationary and does not rotate about an axis to unwind.

DISCLOSURE OF INVENTION

Dispensers for rolled material disclosed have a receptacle forming an inner chamber for containing and protecting a rolled material such as rolled tissue and rolled towels. The receptacle has a handle for gripping and/or wall mounting. One embodiment has a cup-like lower body member with a removable interfitting lid and the dispenser slot is either in the lid or the sidewall of the lower body member. Another embodiment has an inner body member nesting in an outer body member with a dispensing passage and dispensing slot formed between opposite walls of the two body members.

BRIEF DESCRIPTION OF THE DRAWINGS

Details of this invention are described in connection with the accompanying drawings which like parts bear similar reference numerals in which.

DETAILED DESCRIPTION

Figure 1:
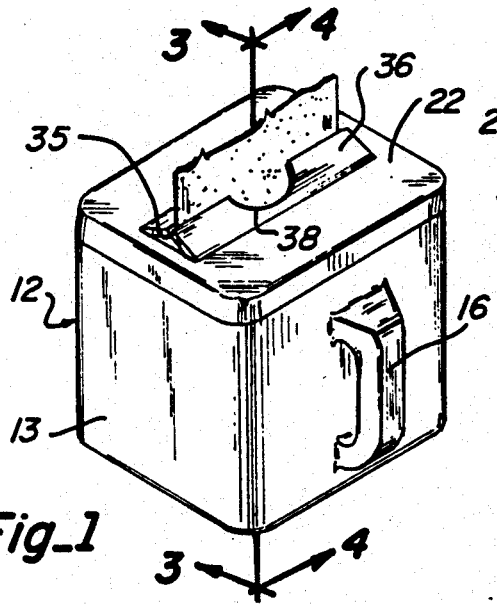
FIG. 1 is a top perspective view of a dispenser for rolled material embodying features of the present invention.
Figure 3:
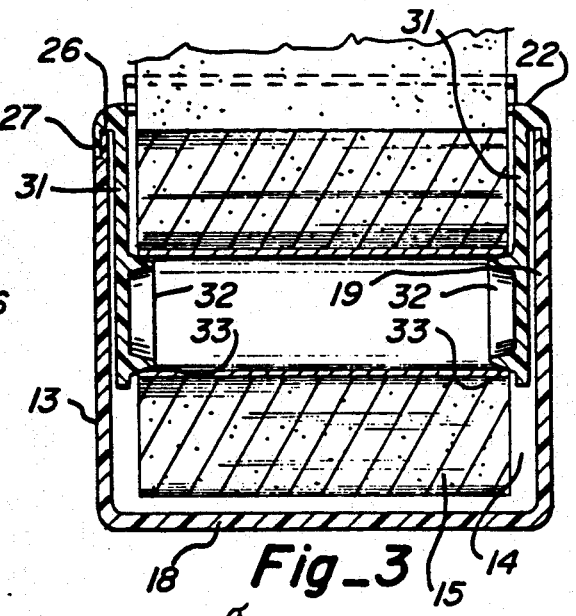
FIG. 3 is a sectional view taken along line 3—3 of FIG. 1.
Figure 2:
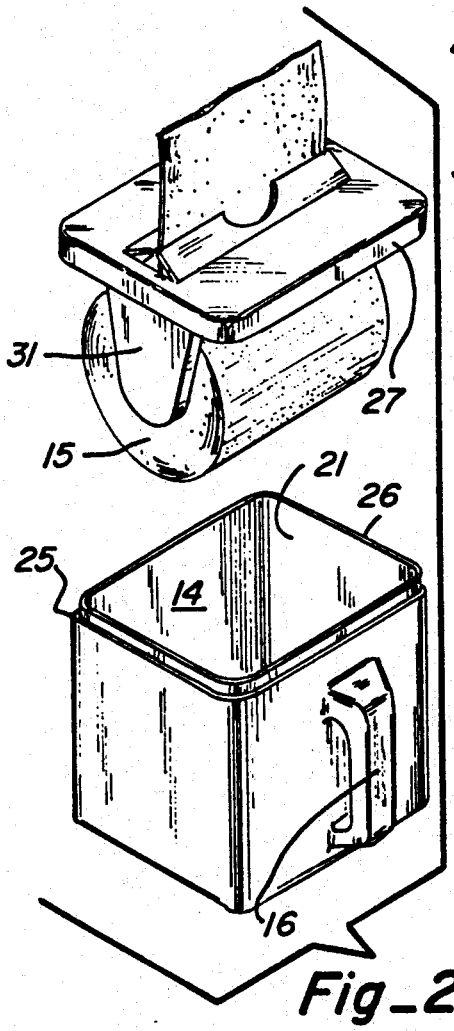
FIG. 2 is an exploded perspective view of the dispenser shown in FIG. 1 having two body members separated for access to the rolled material.
Figure 4:
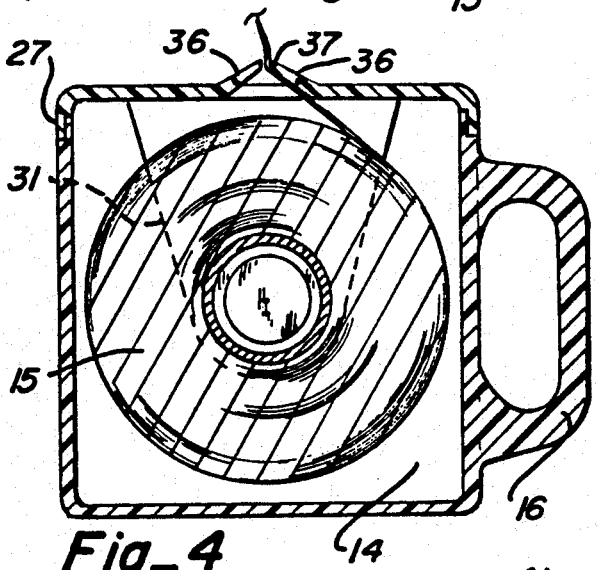
FIG. 4 is a sectional view taken along line 4—4 of FIG. 1.

Referring now to FIGS. 1–4 there is shown a dispenser 12 which in general includes a container or receptacle 13 forming an inner chamber 14 for containing and protecting a rolled material 15 such as a roll of toilet tissue. An upright handle 16 on the receptacle facilitates its picking up and carriage from place to place.

The receptacle 13 shown includes a cup-like lower body member 17 of generally rectangular shape including a bottom wall 18 and four upstanding walls 19 arranged in a box-like configuration transverse to and projecting up from the bottom wall and defining a top access opening 21. Another body member is in the form of a generally flat cover lid 22 provided to selectively close the opening 21 to form an essentially closed inner chamber 14. The lower body member 17 is formed with a step on recess 25 in the top edge to provide an inset or recessed top rim 26. The cover has a depending flange portion or downturned lip 27 of the lid so the lid overlaps the recessed top rim 26 of the lower body member and the outer wall surface of the lower body member is flush with the outer surfaces of the flange portion 27.

The lid 22 further has a pair of opposed, parallel spaced, depending support members 31 secured at the top end to the lid and supporting a pair of opposed and spaced apart support hubs 32. The construction of the dispenser is preferably of a molded plastic material and the support members will flex to a spread position away from one another to allow the rolled material to be passed between the support hubs and then return to the original position to support the roll for unrolling. The open ends of the rolled material fit over the support hubs and suspend and support the roll of material for unrolling in response to a pulling force applied to the free end portion of the roll. The hubs 32 shown are circular and hollow and have an externally tapered peripheral surface 33 that has a decreasing external dimension in a direction away from the supporting wall of member 31.

The lid is provided with an elongated dispensing slot 35 that is formed by providing a pair of opposed, inclined flap-like sections 36 extending up and at an angle to the plane of the top wall of the lid. Each section 36 has a top edge or lip 37. An enlarged aperture 38 of circular shape is provided at an intermediate position between the ends of said slot to facilitate the gripping of and pulling on the free end portion of the rolled material so the material may be pulled through the slot and torn along one of the lips 37. The inside surfaces of sections 36 are arranged substantially along a tangent line with the roll to enhance the unrolling of the material.

In order to remove and replace the rolled material the lid 22 is readily pulled apart from the lower body member 17 and the support hubs 32 can be spread to remove the core of the rolled material. A new roll is readily inserted between the hubs and the lid with rolled material is inserted into the lower body member 17.

Figure 5:
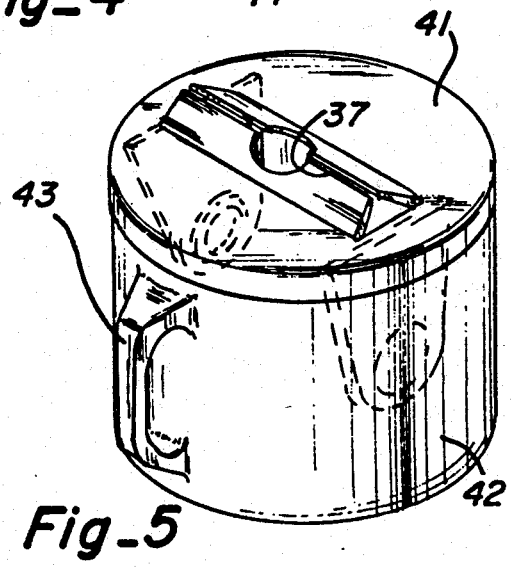
FIG. 5 is a top perspective view of a dispenser similar to that shown in FIGS. 1–4 but of cylindrical form.

The embodiment shown in FIG. 5 is of substantially identical construction with that shown in FIGS. 1–4 but has a circular lid 41 and a hollow cylindrical lower body member 42 with an upright handle 43 mounted on the sidewall of member 42.

Figure 6:
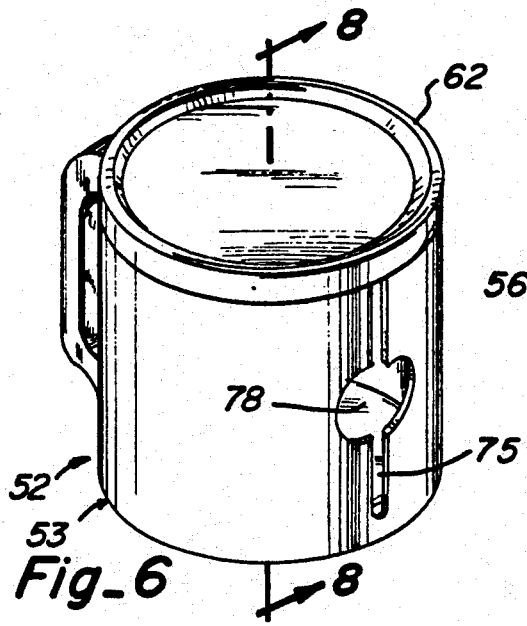
FIG. 6 is a top perspective view of another embodiment of a dispenser for rolled material having a vertical slot and an end portion of the material extending therefrom shown in dashed lines.
Figure 8:
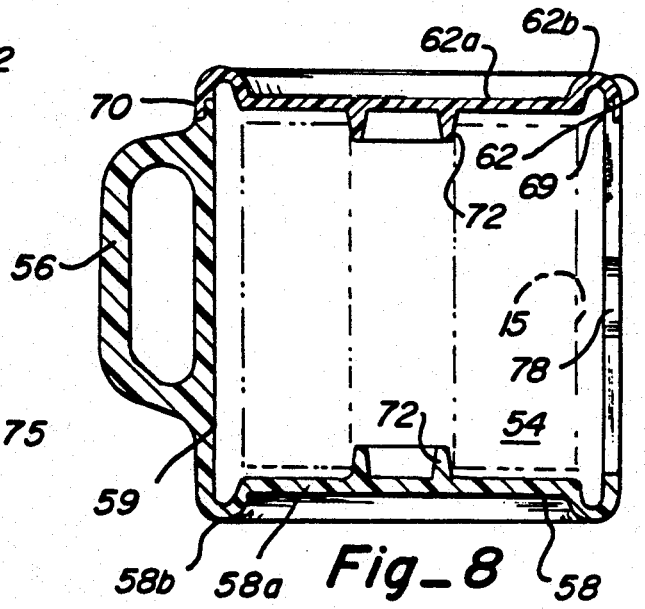
FIG. 8 is a sectional view taken along lines 8—8 of FIG. 6 with the rolled material shown in dashed lines.
Figure 7:
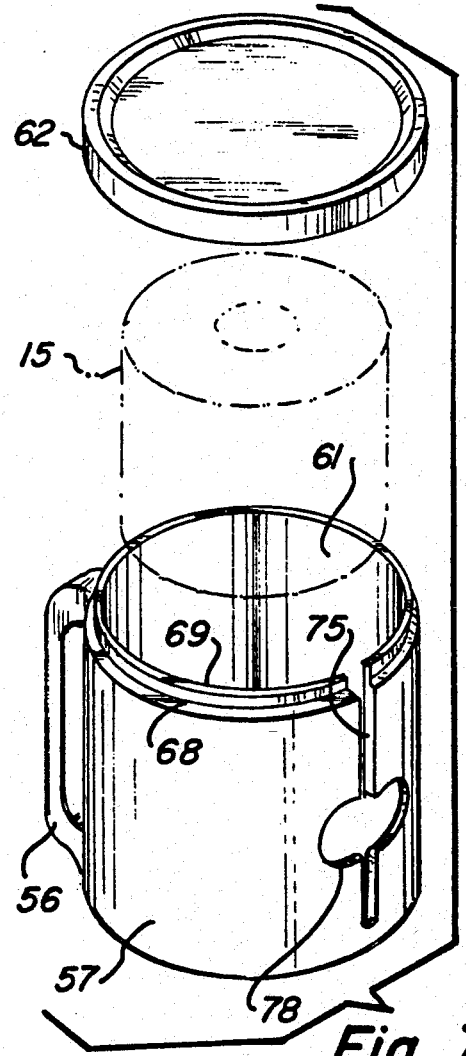
FIG. 7 is an exploded perspective view of the embodiment shown in FIG. 6 having the two body members shown separated and the rolled material shown in a removed position in dashed lines.
Figure 9:
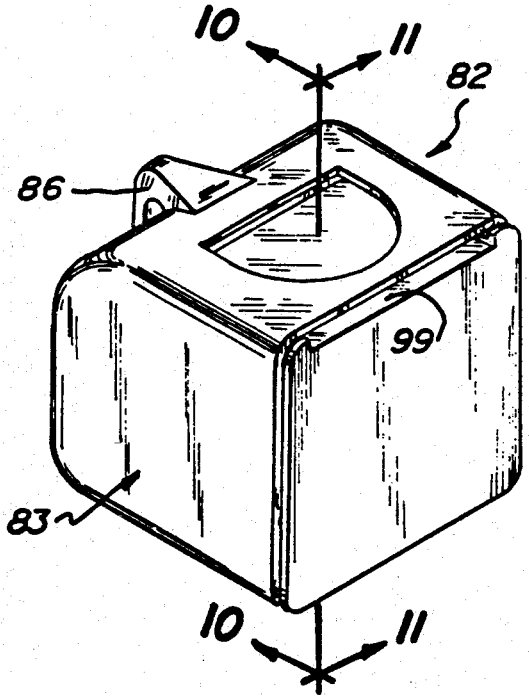
FIG. 9 is a top perspective view of yet another embodiment of a dispenser for rolled material having nestable body members with an end portion of the material extending therefrom shown in dashed lines.

Referring now to FIGS. 6 through 8 there is shown a dispenser 52 which includes a cylindrical receptacle 53 forming an inner chamber 54 for containing a rolled material 15. An upright handle 56 is affixed to the receptacle. This receptacle includes a generally cylindrical, hollow, cup-like lower body member 57 having a bottom wall 58 and a cylindrical upstanding wall 59 with the upper edge opposite wall 58 defining a top access opening 61. A circular lid 62 fits down on the top of the lower body member 5. A pair of opposed support hubs 72 are formed in the bottom of the lid 62 and the top of the bottom wall.

Figure 7A:
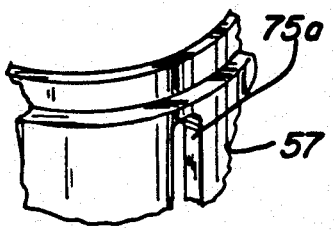
FIG. 7A is a modification of the dispensing slot shown in FIG. 7 that is closed on both ends in the lower body member.
Figure 10:
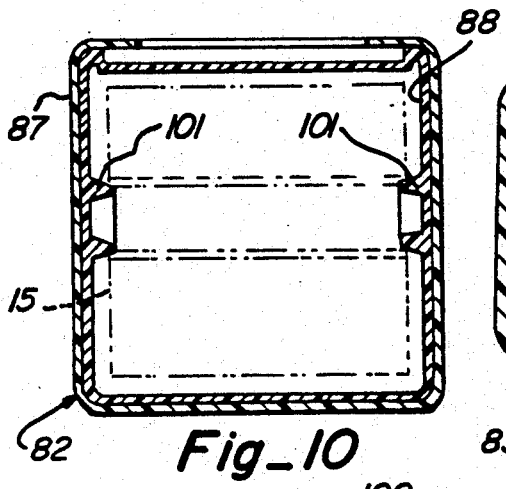
FIG. 10 is a sectional view taken along line 10–10 of FIG. 9 with the rolled material shown in dashed lines.
Figure 11:
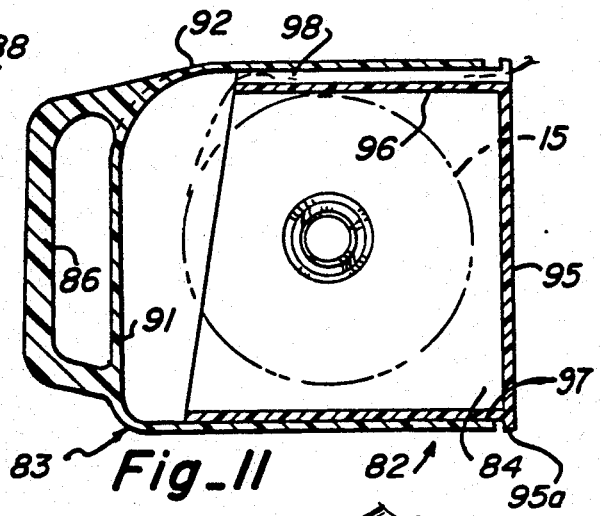
FIG. 11 is a sectional view taken along line 11—11 of FIG. 9 with the rolled material shown in dashed lines.

The bottom wall shown is made up of a generally flat lower central portion **58*a* and a downwardly protruding hollow annular portion 58*b* along the periphery of portion 58*a* so that the central portion 58*a* is located above the supporting surface by the annular portion 58*b*. The lid 62 shown is generally symmetrical with the bottom wall and includes a generally flat upper central portion 62*a* and an upwardly protruding hollow annular portion 62*b* along the periphery of the upper central portion 62*a* and forming a top recessed area in the lid. The upstanding wall 59 is formed with a step or recess 68 in the top edge to provide an inset or recessed top rim 69. The lid 62, in turn, has a depending flange or downturned lip 70 so that the flange 70 overlaps the top rim 69 and the outer surfaces are flush. A vertical dispensing slot 75 is formed in the sidewall opposite the handle 56. This slot 75 shown is open at the top end of the lower body member. An enlarged aperture 78 shown as circular is located at an intermediate position in the slot 75 for grasping the end of the material. The modified form shown in FIG. 7A has both ends of the slot 75*a*** closed in the lower body member when the lid is removed.

Figure 12:
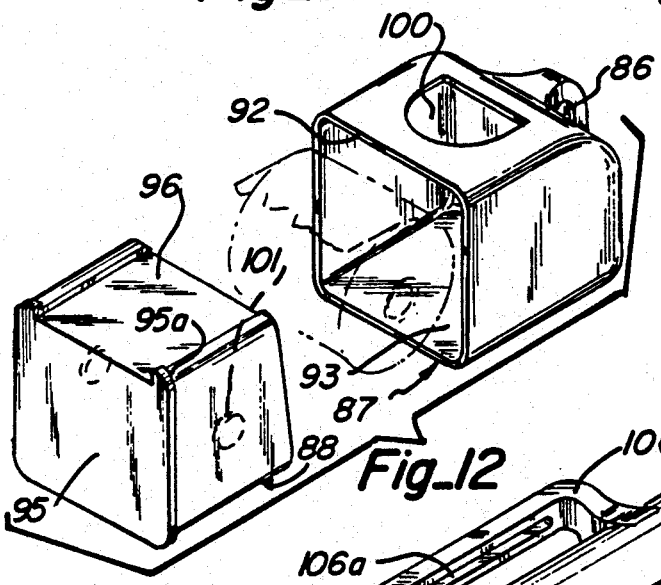
FIG. 12 is an exploded perspective view of the dispenser shown in FIGS. 9–11 with the rolled material shown in a removed position in dashed lines.

Referring now to FIGS. 9 through 12, there is shown another embodiment of a dispenser 82 which includes a container or receptacle 83 defining an inner chamber 84 containing a roll of material 15. An upright handle 86 is mounted on the receptacle. The receptacle includes an outer body member 87 with an inner body member 88 nestable therein. The outer body member 87 is generally cup-like and generally square in form having an end wall 91 and four transverse walls 92 arranged in box-like configuration with an open end 93 opposite the end wall 91. The length, height and depth dimensions of the walls are substantially the same. Similarly, the inner body member 88 is cup-like and generally square in form having an end wall 95 and four transverse walls arranged in a box-like configuration extending transverse to the end wall with an open end 97. The end walls 91 and 95 of these two body members are disposed opposite one another. The top transverse wall 96 of the inner body member is recessed in relation to the ends of the two adjacent transverse walls so that when the inner wall of the inner body member is within the opposite wall of the outer body member there is formed an elongated passage 98 having a discharge slot 99 for the rolled material. The end wall 95 of the inner body member extends beyond the transverse walls to form a flange portion **95*a* that butts against the end of the transverse walls of the outer body member 87 to limit the extend of insertion of the inner body member into the outer body member and to provide a flush outer surface for the receptacle. A pair of tapered support hubs 101 are supported on opposite transverse walls of the inner body member for the unrolling the roll of material about a substantially horizontal axis. An opening 100 in the top transverse wall of the outer body member enables the user to advance the roll of material through the passage 98 and slot 99. The upright handle 86, specifically is mounted on the end wall 91 of the outer body member opposite the discharge slot. In use, the two members are readily separated as shown in FIG. 12 and the walls will flex apart so the roll may be placed on the support hubs 101 inside the inner body member 88**.

Figure 14:
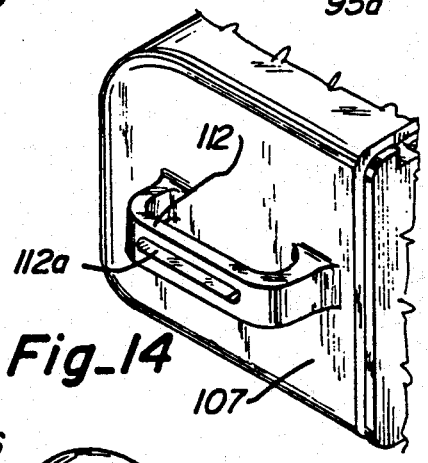
FIG. 14 is a fragmentary perspective view of a modified form of dispenser from that shown in FIGS. 10–12 with the handle shown mounted on one end wall of the outer body member.
Figure 13:
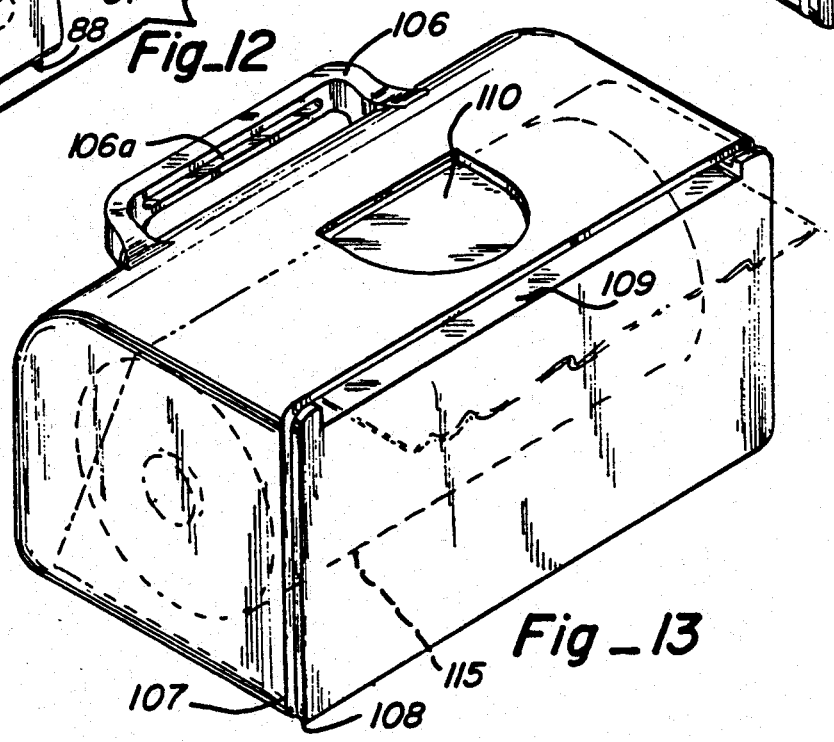
FIG. 13 is a top perspective view of another embodiment of a dispenser for rolled material such as a roll of towel paper having nestable body members.

Referring now to FIG. 13, the dispenser shown is similar in construction to dispenser 82 above described but is specifically adapted to hold a rolled towel 115. This dispenser includes a receptacle 103 defining an inner chamber. Receptacle 103 and the inner chamber formed are generally oblong in form in that they are elongated having a length dimension substantially greater than the height or depth dimension. This elongation in the length is greater than about two times the height or depth dimension. The receptacle has a horizontal handle 106 with a slot **106*a*. The receptacle includes an oblong, hollow outer body member 107 with an oblong, hollow inner body member 108 nestable therein. A discharge slot 109 at the end of a discharge passage passes the end of the rolled material therethrough. A top opening 110 provides access to advance the material through the passage. A modified form shown in FIG. 14 has a horizontal handle 112 with slot 112*a*** in a side wall to enable its being fastened to a wall for support on a wall as by a nail, screw, or the like.

Figure 15:
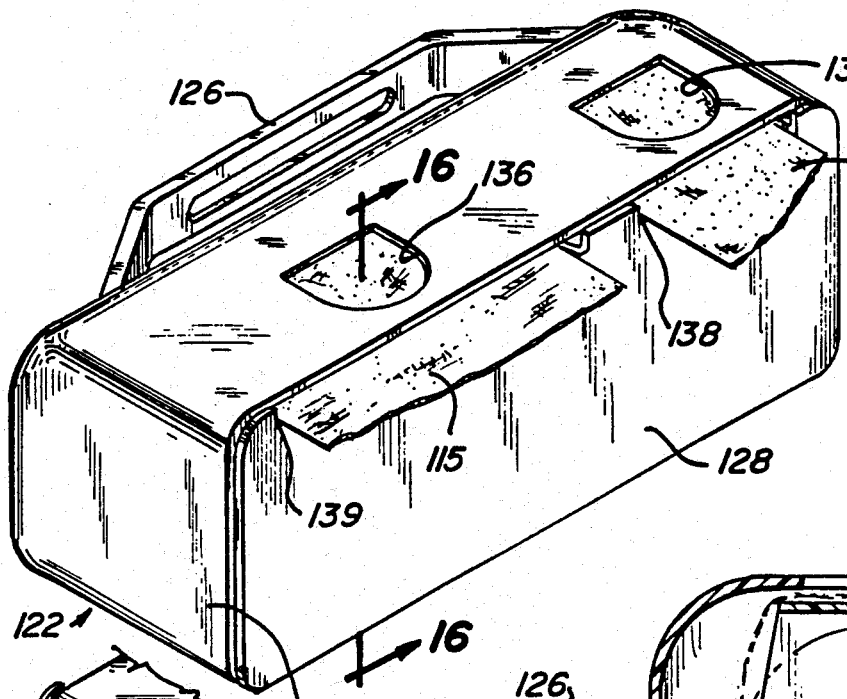
FIG. 15 is a top perspective view of yet another embodiment of a dispenser for two rolls of material such as rolled towel and rolled tissue.
Figure 16:
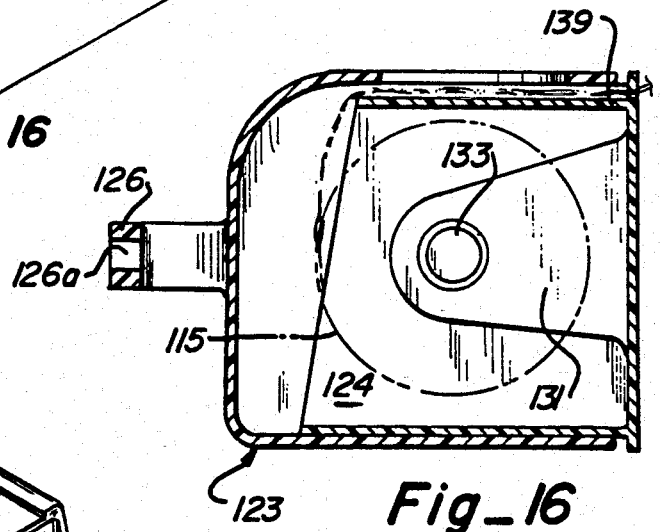
FIG. 16 is a sectional view taken along lines 16—16 of FIG. 15.
Figure 17:
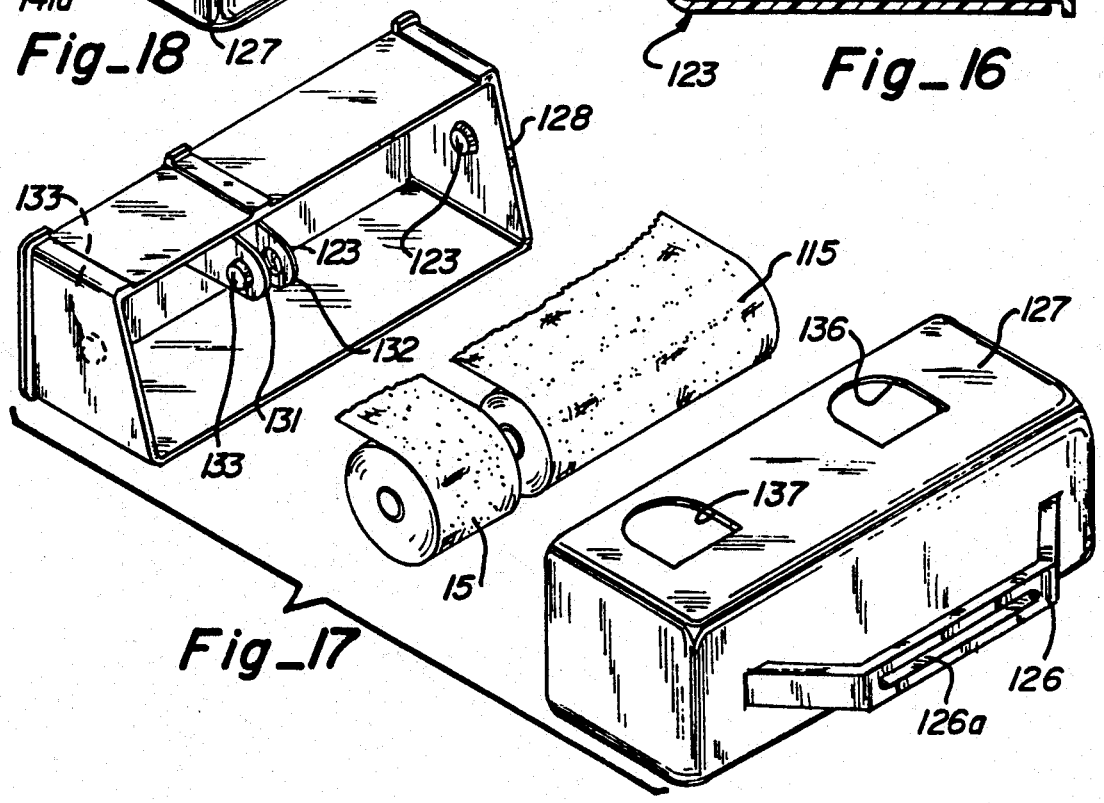
FIG. 17 is an exploded perspective view of the dispenser shown in FIGS. 15 and 16 with the two rolls of material shown in a removed position.

Referring now to FIGS. 15 through 17 there is shown yet another form of embodiment of the dispenser 122 including a receptacle 123 defining an inner chamber 124 suitable for holding both a rolled towel 115 and a rolled tissue 15. Receptacle 123 and chamber 124 are generally oblong in form. The elongation in the length is greater than about three times the height or depth dimensions. The receptacle 123 has a horizontal handle 126 with a slot 126*a*. The receptacle 123 includes an oblong, hollow outer body member 127 and an oblong, hollow inner body member 128 that nests in the inner body member similar in construction to that described with respect to FIGS. 10–14. The outer body member 127 has a pair of opposed support members 131 and 132 each with a tapered support hub 123 for supporting the two rolls. The top wall of the outer body member has two openings 136 and 137 to enable the rolls 15 and 115 to be advanced through two dispensing slots 138 and 139, respectively.

Figure 18:
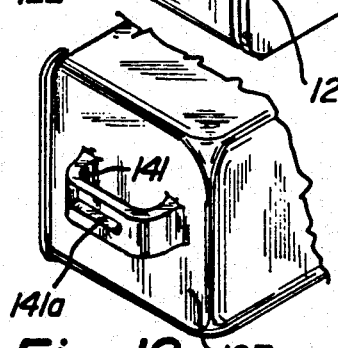
FIG. 18 is a fragmentary perspective view of a modified form of dispenser from that shown in FIGS. 15–17 with the handle shown in one end wall of the outer body member.

A modified form shown in FIG. 18 has a horizontal handle 141 with a slot 141*a* in the side wall of the outer member 127.

Although the present invention has been described with a certain degree of particularity, it is understood that the present disclosure has been made by way of example and that changes in details of structure may be made without departing from the spirit thereof.

What is claimed is:

1. A dispenser for rolled material comprising:

a receptacle forming an inner chamber for containing a rolled material, said receptacle including separable hollow first and second body members which when separated enable the insertion of said rolled material into said chamber and when fitted together enclose and support said rolled material in said chamber, each body member being cup-like and having wall means to substantially surround said rolled material entirely, said wall means including a substantially planar end wall and four transverse walls arranged in a five-sided configuration extending transverse to and projecting away from the associated end wall with top, bottom, and opposed side walls and an open end opposite the associated end wall, an inner of said body members slidably nesting within an outer of said body members when together to form a six-sided receptacle for said material having four double walls with an interfitting connection between said body members, said body members being arranged to face in opposite direction so said end walls are at opposite ends of said receptacle, one transverse wall of said inner body member being recessed in relation to the ends of two adjacent walls so that said one wall of said inner body member is spaced from an opposite wall of the outer body member to form an elongated planar passage having a discharge slot at one end through which a free end portion of said material is passed during dispensing, said discharge slot having a dimension sufficient to accommodate the full width of said rolled material, a pair of opposed support hubs on opposite upright side walls of said inner body member for unrolling the material about a substantially horizontal axis by pulling on a leading end portion, and a handle on said outer body member.

2. A dispenser as set forth in claim 1 wherein said handle is on a transverse side wall of said body member and arranged generally transverse to said dispensing slot.

3. A dispenser as set forth in claim 1 wherein said handle is on an end wall of said body member and arranged generally parallel to said dispensing slot.

4. A dispenser as set forth in claim 1 including at least one opening in a transverse wall of said outer body member to enable the user to advance the rolled material through said passage and slot.

5. A dispenser as set forth in claim 1 wherein there are two sets of said pairs of support hubs arranged end to end in said inner body member to support two rolls of material and two associated openings in said outer member to enable the user to advance the rolled material.

6. A dispenser as set forth in claim 1 wherein said handle is generally horizontally disposed on an end wall of said outer body member.

7. A dispenser as set forth in claim 1 wherein said handle has an elongated slot to facilitate mounting of said dispenser on a support surface.

8. A dispenser as set forth in claim 1 wherein said receptacle is generally square in form.

9. A dispenser as set forth in claim 1 wherein said receptacle is generally oblong in form.

10. A dispenser as set forth in claim 1 wherein said end wall of said inner body member extends beyond the side walls to form a flange portion that abuts against an edge of the outer body member to limit the extent of insertion of the inner body member into the outer body member.

* * * * *